United States Patent [19]

Hall et al.

[11] Patent Number: 4,548,431

[45] Date of Patent: Oct. 22, 1985

[54] TOOL JOINT WITH INTERNAL/EXTERNAL MAKE-UP SHOULDERS

[75] Inventors: James R. Hall, Huffman; Robert A. Cunningham, Bellaire, both of Tex.

[73] Assignee: Hughes Tool Company - USA, Houston, Tex.

[21] Appl. No.: 661,533

[22] Filed: Oct. 16, 1984

Related U.S. Application Data

[63] Continuation-in-part of Ser. No. 331,934, Dec. 17, 1981, abandoned.

[51] Int. Cl.[4] ..... F16L 25/00

[52] U.S. Cl. ..... 285/334; 285/390

[58] Field of Search ..... 285/333, 334, 355, 390; 403/353

[56] References Cited

U.S. PATENT DOCUMENTS

| | | | |
|---|---|---|---|
| 1,393,057 | 10/1921 | Vollmer | 285/355 X |
| 2,045,520 | 6/1936 | Davison | 285/333 X |
| 2,532,632 | 12/1950 | MacArthur | 285/334 X |
| 2,825,585 | 4/1958 | Griffin | 285/333 X |
| 3,572,771 | 3/1971 | Redwine | 285/333 X |
| 3,572,777 | 3/1971 | Blose | 285/334 |

*Primary Examiner*—Dave W. Arola

*Attorney, Agent, or Firm*—Robert A. Felsman; James E. Bradley

[57] ABSTRACT

A tool joint for earth boring drill pipe members has features that increase the amount of torque required to yield the connection. The tool joint has both external and internal make-up shoulders. The pin and box are dimensioned so that the box face contacts the external shoulder while there still is a clearance between the pin face and the internal shoulder. At normal make-up torque, the external shoulder will be tightened to its normal amount. The internal shoulder will tighten to its yield only if additional torque is encountered while drilling. The internal shoulder adds to the amount of torque required to yield the tool joint connection.

2 Claims, 1 Drawing Figure

TOOL JOINT WITH INTERNAL/EXTERNAL MAKE-UP SHOULDERS

CROSS REFERENCE TO RELATED APPLICATION

This application is a continuation-in-part of application Ser. No. 331,934, filed Dec. 17, 1981 and now abandoned.

BACKGROUND OF THE INVENTION

This invention relates in general to earth boring drill pipe, and in particular to the tool joints for connecting the sections of drill pipe together.

Deep wells such as for oil and gas are drilled with a rotary drill bit rotated by a string of drill pipe. The drill pipe is made-up of individual members, each about 30 foot in length. The members are secured together by a threaded connection, called a tool joint. The tool joints must withstand the normal torque encounted during drilling, and also provide sealing to prevent drilling fluid being pumped down the drill pipe from leaking out the joints. Leakage out the tool joints causes wear due to the abrasiveness of the drilling fluid, which would lead to early failure.

The tool joint is made-up of a pin member and a box member. The pin member has external threads and an external annular make-up shoulder. The box member has internal threads and a rim or face that makes up against the make-up shoulder. In conventional drill pipe, there is no internal shoulder in the box member for contact by the nose or face of the pin. When the tool joint members are made-up at the surface, normally they will be made-up to a torque that exerts a pressure that is about one-half the yield strength between the box face and pin make-up shoulder.

Should additional torque be encountered while drilling, such as due to the bit or pipe becoming stuck, it is possible for the yield strength of the pin and box to be exceeded. Consequently, it is very important to have tool joints with high torque withstanding abilities, preferably in excess of the drill pipe itself.

SUMMARY OF THE INVENTION

In this invention, a tool joint is provided that has a substantially increased yield strength without any additional thickness in the pin or box, and without further hardening of the steel. The box is provided with an internal shoulder located below its threads. The pin has a face on the end of its nose that mates with the internal shoulder in the box. The dimensions of the pin and box are calculated so that when hand tightened, the box face will contact the external shoulder of the pin. A clearance, however, will exist between the pin face and the internal shoulder of the box. When the tool joint is fully made-up to its normal make-up torque, the box face will engage the external make-up shoulder to the normal pressure, which is about one-half the yield strength of the tool joint. The pin face will exert little or no pressure against the internal shoulder at normal make-up torque.

During drilling operations, if torque in excess of make-up torque is encountered, the tool joints will further tighten. The counterbore of the box and the pin base section will deflect, causing the pin face to engage and tighten against the internal shoulder. The make-up of the pin face and internal shoulder occurs prior to any permanent deformation occurring in the box counterbore and pin base sections.

DESCRIPTION OF THE PREFERRED EMBODIMENT

Figure 1:
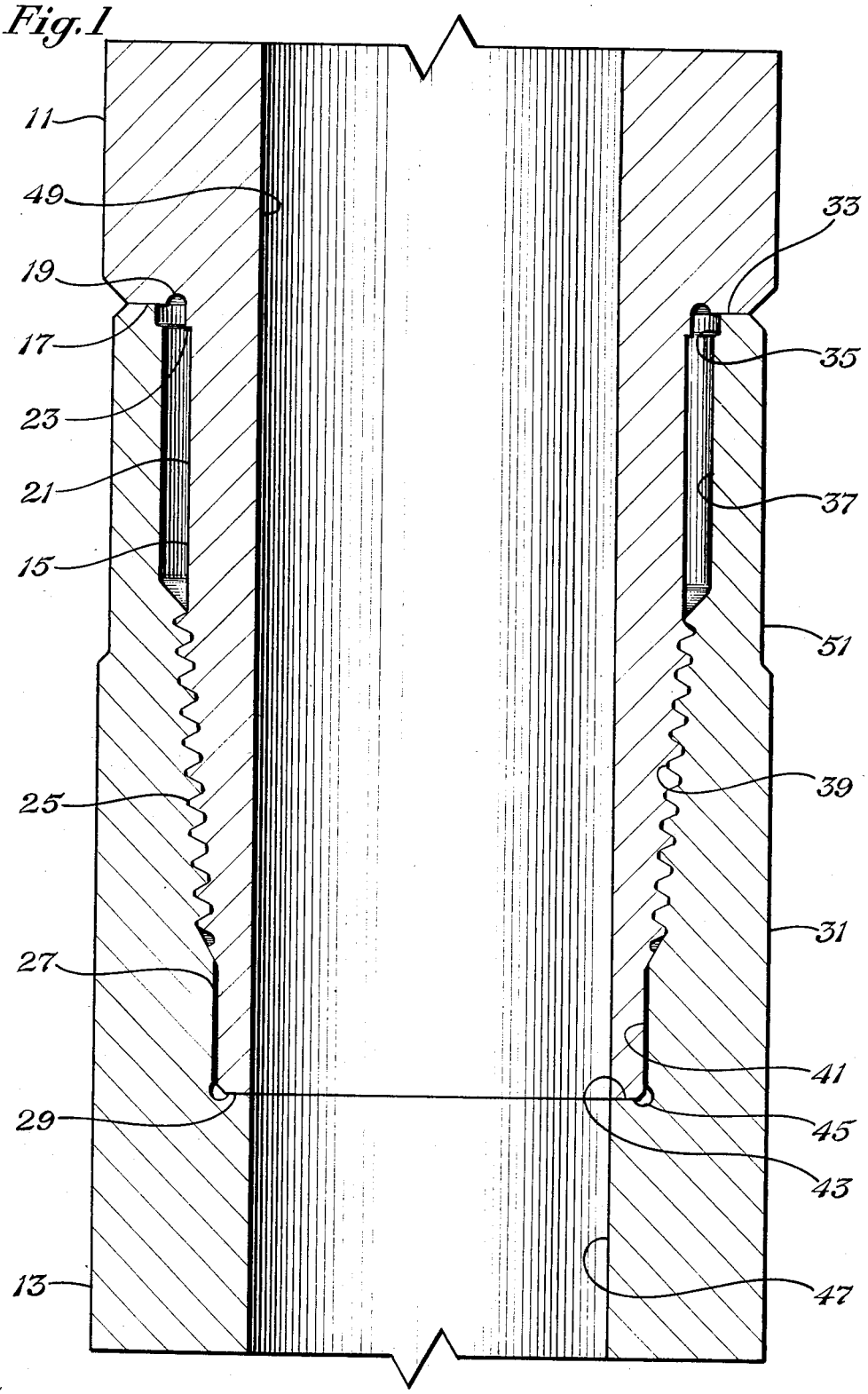
FIG. 1 is the sole FIGURE, and it shows a cross-sectional view of a tool joint constructed in accordance with this invention.

FIG. 1 shows an upper drill pipe member 11 secured into a lower drill pipe member 13. The ends of the drill pipe members 11 and 13, when connected together, are known as a tool joint. A pin 15 is formed on the lower end of upper drill pipe member 11, and also on the lower end (not shown) of the lower drill pipe member 13. Pin 15 has an external, annular make-up shoulder 17. A relief groove 19 is located at the inner diameter of external shoulder 17.

A base section 21 extends downward from external shoulder 17. Base section 21 is cylindrical and does not contain any threads. A bench mark shoulder 23 is formed a short distance downward from make-up shoulder 17 for use in measuring the amount of metal removed from make-up shoulder 17 when redressed. A set of threads 25 is formed on pin 15 below base section 21. Threads 25 are tapered and terminate in a cylindrical nose section 27. Nose section 27 terminates in a face 29, which is a circular rim located in a plane perpendicular to the axis of the drill pipe member 11.

The upper end of lower drill pipe member 13, as well as the upper end (not shown) of the upper drill pipe member 11, has a box 31 formed on it. Box 31 receives pin 15 and includes a rim or face 33 on its upper extremity. Face 33 is a circular, flat surface located in a plane perpendicular to the axis of lower drill pipe member 13. Face 33 engages external shoulder 17 of pin 15. The inner bore of box 31 includes an upwardly facing shoulder 35 formed a short distance below face 33 for serving as a bench mark. Bench mark 35 enables the user to determine how much metal has been removed from face 33 during redressing operations.

A cylindrical counterbore section 37 is located immediately below bench mark 35. Counterbore section 37 extends about the same length as base section 21, but has an inner diameter that is greater than the outer diameter of base section 21. This results in an annular cavity between the base section 21 and counterbore section 37. A set of internal threads 39 are located below the counterbore section 37. Threads 39 are tapered and sized to engage threads 25.

Box 31 has a cylindrical base section 41 located below threads 39. Base section 41 terminates in an annular upwardly facing internal shoulder 43. Shoulder 43 is located in a plane perpendicular to the axis of lower drill pipe member 13, and is adapted to be engaged by pin face 29. A relief groove 45 is formed at the intersection of internal shoulder 43 and base section 41. An axial passage 47 of box 31 below internal shoulder 43 is equal to the diameter of an axial passage 49 of pin 15. An annular recessed area 51 is formed on the exterior sidewall of counterbore section 37. Recessed area 51 has a slightly smaller diameter than the outer diameter of the portion containing threads 39.

The box 31 and pin 15 are dimensioned so that the distance from the external shoulder 17 to pin face 29 is slightly less than the distance from the box face 33 to internal shoulder 43. The box 31 and pin 15 are dimensioned so that at the surface, when two members 11 and 13 are made-up manually hand tight without the use of wrenches or tools, a clearance will exist between pin face 29 and internal shoulder 43. At hand tight, there will be no pressure between box face 33 and external shoulder 17, although they will contact each other.

In operation the drill pipe members 11 and 13 are made-up to a torque that provides pressure equal to about one-half the yield strengths of the pin base 21 and box counterbore section 37. The yield strength is the pressure, either compression or tension, at which either the pin base 21 or the box counterbore section 37 will permanently deform. As torque is applied, counterbore section 37 compresses and pin base 21 lengthens, resulting in the pin face 29 advancing downward. At make-up torque, pin face 29 will be spaced closely to, or possibly even in contact with the internal shoulder 43. However any pressure at internal shoulder 43 is less than at external shoulder 17 at make-up.

The drill pipe members are then lowered into the well and rotated for drilling. During drilling, additional torque might be encountered if the drill bit or structure on the lower end of the drill string becomes stuck. Further compression of counterbore section 37 and lengthening of the pin base 21 by the additional torque will cause the pin face 29 to press against the internal shoulder 43 and make-up tightly. Normally, the make-up of the pin face 29 and the internal shoulder 43 will provide a sufficient amount of increased strength to withstand the extra torque without any permanent deformation. This allows the tool joints 11 and 13 to be subsequently reused and connected with other tool joints. However, if the additional torque continued, the dimensions are such that the yield strength of the nose section 27 will be reached approximately the same time or no later than the time at which the cumulative yield strengths of the pin base section 21 and box counterbore section 37 are reached.

The base section 21, counterbore section 37 and nose section 27 serve as spring means for causing the box face 33 to tighten against external shoulder 17 to a pressure at make-up torque in excess of the pressure, if any, that pin face 29 imposes against internal shoulder 43. The lengths are selected to provide sufficient spring to allow deflection of these members and result in the make-up of the internal shoulder 43 if additional torque is encountered during drilling. To explain how these dimensions are determined, an actual example for modification of an A.P.I. (American Petroleum Institute) standard 3½ inch I.F. tool joint will be discussed. First, the bores 47 and 49 are standard diameter bores for this size of tool joint, this dimension being 2.688 inch. The outer diameter of base section 21 is selected to be 3.668 inch, which is the minimum outer diameter of a standard tool joint pin at its last engaged pin thread. This minimum thickness of the base section 21 is selected to assure that the pin 15 will not have less strength than a base section of a prior art pin. The cross-sectional area of the base section 21 calculates to be 4.892 square inches.

To assure that the counterbore section 37 does not fail substantially earlier than the pin base section 21, the cross-sectional area of the counterbore section 37 is selected to be substantially the same as that of the base section 21. In the preferred embodiment, to achieve this, the counterbore diameter is determined by the standard counterbore diameter of a tool joint box. The outer diameter of the recessed area 51 is then calculated to result in the cross-sectional area of the counterbore section 37 being substantially the same as that of the pin base section 21. The recessed area 51 serves to prevent wear on the outer diameter of counterbore section 37, which might otherwise reduce the cross-sectional area to below the design amount. If reduced below the design requirements, the counterbore section 37 might fail earlier than the base section 21. In the preferred embodiment, the outer diameter of the recessed section 51 is 4.813 inch. In the preferred embodiment, the inner diameter chosen is 4.078 inch, this resulting in a cross-sectional area of 5.132 square inches. The difference in areas of pin base section 21 and counterbore section 37 is 0.24 square inches, a difference of about 5 percent.

Next, the length of the counterbore section 37 is selected. This length must be sufficient to provide a considerable deflection when torque is applied. In the preferred embodiment, a length of about two inches was selected for the counterbore section 37. This results in a length of the base section 21 being slightly greater due to the engagement of the threads, this becoming 2.19 inch.

The amount of deflection at yield can then be determined by dividing the yield strength for the steel for this tool joint by Young's Modulus, this being 120,000 divided by 28,600,000, resulting in 0.004 inch per inch. That is, at the yield stress of 120,000 psi (pounds per square inch) being exerted on a steel member of this type, the member will deflect, either in compression or in tension, 0.004 inch for each inch of length of the member.

During make-up, the counterbore section 37 will compress and the base section 21 will elongate. At a torque that results in one-half the yield strength, 60,000 psi (pounds per square inch), the base section 21 elongation will be 2.19 inch multiplied by 0.004 inch per inch, and divided by 2, equaling 0.00438 inch. The counterbore section 37 will compress by an amount equal to two inches in length times 0.004 inch per inch divided by two, and multiplied by the ratio of the cross-sectional area of the base section 21 over the cross-sectional area of the counterbore section 37. This results in a total deflection at one-half yield strength of 0.00381 inch. Consequently, the total relative motion of the pin face 29 at one-half the yield strength is the sum of 0.00438 and 0.00381 or 0.00819 inch. At three-fourth yield strength the deflection is 0.01228 inch and at full yield, the deflection is 0.01638 inch.

The dimensions of the nose section 27 are selected by choosing a length that will cause the nose section to reach yield strength simultaneously or slightly sooner than the pin base section 21 and counterbore section 37 if sufficient additional torque is encountered. To avoid making the length longer than necessary, a criteria that the pin face 29 contact initially internal shoulder 43 only at three-fourth yield was chosen. At this point, pin base section 21 and counterbore section 37 will have moved pin face 29 downward 0.01228 inch. To reach full yield, pin base section 21 and counterbore section 23 must deflect an additional 0.00409 inch. Nose section 29 will compress 0.00409 inch because of this deflection. The length of nose section 29 is selected to reach full yield when compressed 0.00409 inch. We previously noted that deflection of this type of steel is the yield strength over Young's Modulus or 0.004 inch per inch. Since approximately 0.004 inch of compression is needed in nose section 29 to reach full yield simultaneously with pin base section 21 and counterbore section 37, the length of nose section 29 should be one inch.

For the outer diameter of nose section 29, the threads 25 and 39 were truncated as much as possible without reducing their strength. The selected length is about 2⅜ inches. A diameter slightly less than the minimum outer diameter at the truncated end of the threads was selected to be the outer diameter of nose section 27, which in the preferred embodiment is 3.188 inch.

The next dimension to determine is the positioning of the internal shoulder 43. A criteria in the design is that at full make-up torque, which is one-half yield strength at external shoulder 17, the pin face 29 will exert little if any pressure against the internal shoulder 43. We had previously determined that pin face 29 will move downward 0.00819 inch at full make-up torque and one-half yield strength. A clearance of 0.012 inch between pin face 29 and internal shoulder 43 at hand tight would thus reduce to about 0.004 inch at full make-up torque because of the 0.00819 inch movement due to the deflection of pin base section 21 and counterbore section 37. Additional torque encountered up to three-fourths of the yield at the external shoulder 17 would result in a deflection of pin base section 21 and counterbore section 37 of an additional 0.00409 inch. This places the pin face 29 initially in contact with the internal shoulder 43 at three-fourth yield. Additional torque from three-fourths yield to full yield would cause the pin face 29, if unrestrained, to move downward an additional 0.00409 inch. However, since the pin face 29 contacted the internal shoulder 43 at three-fourth yield strength, the nose section 27 will compress for 0.00409 inch. This is the amount of deflection that the nose section 27 undergoes at full yield. This results in the nose section 27 reaching full yield simultaneously with the pin base section 21 and counterbore section 37, if sufficient additional torque is encountered.

To achieve the desired gap between pin face 29 and internal shoulder 43 at hand tight of 0.012 inch, the distance from the box face 33 to the internal shoulder 43 is selected to be 0.012 inch greater than the distance from the pin shoulder 17 to the pin face 29, or 5.742 inch. While this is the ideal dimension, a realistic manufacturing tolerance for this dimension is plus 0 and minus 0.005 inch from the total dimensions of 5.730 and 5.742 inches. This results in a hand tight gap between pin face 29 and internal shoulder 43 of a minimum of 0.007 inch and an ideal maximum of 0.012 inch. If a tool joint has the minimum gap rather than the ideal gap, the nose section 27 will yield before the pin base section 21 or counterbore section 37 yields. Also, at full make-up torque, pin face 29 will exert some compression against internal shoulder 43. This occurs because with a total deflection from hand tight to half yield of 0.00819 inch, a minimum hand tight gap of 0.007 inch will place the nose section 27 under 0.001 inch compression. A deflection of 0.001 inch places nose section 27 at one-fourth yield, while pin base section 21 and counterbore section 37 will be at one-half yield. Nose section 27 will reach its full yield strength at a compression of 0.004 inch. Increasing the torque from one-half yield to three-fourth yield of pin base section 21 and counterbore section 37 causes 0.00409 deflection of these members. Consequently, if enough torque is encountered, the nose section 27 will reach full yield slightly before the base section 21 and counterbore section 37 reach three-fourth yield. This full yield point is not likely to occur, but if it did, it might result in cracking of the nose section 27. However, this will be less detrimental than cracking occurring in the base section 21 or counterbore section 37. Cracking of the nose section 27 will not result in parting of the drill string. Up to, and beyond the point at which the nose section 27 yields, it does provide additional torque withstanding abilities.

The pin base 21 and the box counter 37 each should have a length no less than one-third the length of the engaged threads 25. Also, the pin base 21 should be longer than the pin nose 27. The pin nose 27 should have a length no less than one-sixth the length of the engaged threads 25.

Through standard calculations, the torque to yield pin base section 21 or counterbore section 37 on the above described tool joint at the ideal dimensions is 25,583 foot pounds. A conventional tool joint having a five inch outer diameter and 2 11/16 inner diameter, as does this tool joint, has a torque withstanding ability of only 18,100 foot pounds at full yield. This increase in torque required to yield a tool joint further reduces the changes for parting of the drill string while drilling. The increase in the strength of the tool joint is accomplished without additional metal thicknesses or higher steel strengths.

While the invention has been shown in only one of its forms, it should be apparent to those skilled in the art that it is not so limited but is susceptible to various changes and modifications without departing from the scope of the invention.

We claim:

1. In a drill pipe tool joint having a pin with external threads formed between an external shoulder and a pin face, and a box with internal threads located below a box face for connection with the pin, the improvement comprising:

the box having an internal annular shoulder and a counterbore section between the internal threads and box face;

the pin having a base section between the external shoulder and the external threads and a nose section between the pin face and external threads;

the lengths and thicknesses of the counterbore, base and nose sections being selected so that when the drill pipe tool joint is made-up to one-half of its yield strength, the box face will tighten against the external shoulder to a pressure that exceeds any pressure being exerted by the pin face against the internal shoulder, with the pin face tightening against the internal shoulder if additional torque during drilling is encountered;

the lengths and thicknesses of the counterbore, base and nose sections being selected so as to cause the counterbore section to resiliently compress and the base section to resiliently stretch a sufficient amount to allow the pin face to contact the internal shoulder before the yield strengths of the base and counterbore sections are reached, the length and thickness of the nose section being selected so as to cause the nose section to resiliently compress and to reach yield strength no later than the time at which the base and counterbore sections reach yield strength;

the base section and the counterbore section each having a length that is at least one-third the length of the threads when engaged;

the base section and the counterbore section each having a greater length than the nose section, so that the nose section will reach its yield strength no later than the time at which the base and counterbore sections reach their yield strengths.

2. In a drill pipe tool joint having a pin with external threads formed between an external shoulder and a pin face, and a box with internal threads and a box face for connection with the pin, the improvement comprising:

the box having an internal annular shoulder and a cylindrical counterbore section between the internal threads and box face;

the pin having a cylindrical base section between the external shoulder and the external threads and a cylindrical nose section between the pin face and the external threads;

the distance from the box face to the internal shoulder being greater than the distance from the pin face to the external shoulder, providing a clearance between the pin face and internal shoulder when the box face and external shoulder are made-up hand tight;

the thicknesses and lengths of the counterbore and base sections being selected to deflect under a load equal to full yield strength of the pin base and counterbore sections a distance that is no less than the clearance plus the amount of compression in length that the nose section undergoes under a load equal to the full yield strength of the nose section;

the lengths and thicknesses of the counterbore, base and nose sections being selected so that when the drill pipe tool joint is made-up to one-half of its yield strength, the box face will tighten against the external shoulder to a pressure that exceeds any pressure being exerted by the pin face against the internal shoulder, with the pin face tightening against the internal shoulder if additional torque during drilling is encountered;

the base section and the counterbore section each having a length that is at least one-third the length of the threads when engaged;

the base section and the counterbore section each having a greater length than the nose section so that the nose section will reach its yield strength no later than the time at which the base and counterbore sections reach their yield strengths;

the outer diameter of the box at the counterbore section being less than the outer diameter of the box at the threaded section, to avoid wear on the exterior of the counterbore section.

* * * * *